United States Patent [19]

Moore et al.

[11] Patent Number: 4,800,933

[45] Date of Patent: Jan. 31, 1989

[54] FUNNEL AND TOOL WITH CUTTING ATTACHMENT FOR REMOVING PLUG FROM VEHICLE OIL PAN

[76] Inventors: Arnold P. Moore, 601 S. First St.; Nobel Linn, Jr., 301 W. Washington, both of Benton, Ill. 62812

[21] Appl. No.: 74,712

[22] Filed: Jul. 17, 1987

[51] Int. Cl.[4] ..... B25B 13/06; B67C 11/02

[52] U.S. Cl. ..... 141/98; 141/329; 141/331; 7/100; 7/142; 7/151; 184/1.5; 81/3.09; 81/52

[58] Field of Search ..... 141/1, 98, 329, 330, 141/331, 340, 341, 332–334, 339, 342, 343, 392, 344, 345; 7/100, 138, 142, 151, 152, 156, 158; 81/2, 3.07, 3.08, 3.09, 3.15, 3.19, 52; 184/124.7, 1.5

[56] References Cited

U.S. PATENT DOCUMENTS

| | | | |
|---|---|---|---|
| Re. 17,613 | 3/1930 | McGowan | 184/1.5 |
| 892,000 | 6/1908 | MacKaskie | 141/331 X |
| 967,356 | 8/1910 | Fajen et al. | 141/345 |
| 1,134,837 | 4/1915 | Fox | 141/331 |
| 2,172,577 | 9/1939 | Duncan | 141/331 X |
| 3,331,405 | 7/1967 | Gaudet | 141/330 |
| 4,177,529 | 12/1979 | Sikula, Jr. | 7/100 |
| 4,230,002 | 10/1980 | Skidmore | 81/124.7 |
| 4,267,945 | 5/1981 | Maynard, Jr. | 141/330 X |
| 4,485,853 | 12/1984 | Gunderson | 141/1 |
| 4,592,448 | 6/1986 | Morris | 184/1.5 |
| 4,600,125 | 7/1986 | Maynard, Jr. | 141/331 X |

FOREIGN PATENT DOCUMENTS

| | | | |
|---|---|---|---|
| 525232 | 1/1954 | Belgium | 141/331 |
| 523527 | 8/1921 | France | 141/344 |
| 1110208 | 2/1956 | France | 141/344 |
| 1420585 | 11/1965 | France | 141/329 |
| 581000 | 11/1977 | U.S.S.R. | 184/1.5 |
| 632644 | 11/1978 | U.S.S.R. . | |
| 1027138 | 7/1983 | U.S.S.R. . | |
| 1126539 | 11/1984 | U.S.S.R. | 141/331 |
| 758015 | 9/1956 | United Kingdom | 141/339 |
| 2081129 | 2/1982 | United Kingdom | 141/331 |

*Primary Examiner*—Henry J. Recla
*Assistant Examiner*—Ernest G. Cusick
*Attorney, Agent, or Firm*—John J. Byrne

[57] ABSTRACT

A funnel of a type having a cup and a hollow stem extending from the bottom thereof whereby a plurality of struts support a member that extends upwardly from the center of the cup and is shaped so that it drivingly engages the driven end of a socket wrench.

4 Claims, 2 Drawing Sheets

FUNNEL AND TOOL WITH CUTTING ATTACHMENT FOR REMOVING PLUG FROM VEHICLE OIL PAN

BACKGROUND OF THE INVENTION

I. FIELD OF INVENTION

The invention relates to an oil funnel used to facilitate the removal of the drain plug of the oil pan of a vehicle motor in cooperation with the socket of a conventional ratchet or spanner wrench. The rush of oil, upon removal of the plug, is conveniently gathered by the funnel and directed to a container without soiling the hands, arms and clothing of the user.

II. DESCRIPTION OF THE PRIOR ART

The problem of moving drain plugs from vehicular oil pans without soiling the hands, arms and clothing of the worker has been a problem that has faced the art for many years. This is an especially aggravating situation for people who wish to change vehicular oil themselves. Several in the prior art have addressed the problem but most are without commercial success because of complexity or inconvenience.

For instance, the problem is addressed in the U.S. Pat. No. 4,485,853, to Gunderson, issued Dec. 4, 1984. Gunderson uses a cylindrical member having a flexible plastic sheet under which the user's hand can be inserted so that the user can grip the drain plug through the flexible plastic sheet. The sheet thus protects the hands from the rush of oil. Since Gunderson does not use a funnel, the user must quickly remove the unit from underneath the oil pan prior to the time the container is filled.

The prior art also includes teachings from two Russian patents, namely, SU No. 632-644, issued Nov. 20, 1978 and SU No. 1027-138-A, which issued in July of 1983. SU No. 632-644 includes a funnel which utilizes a spanner. The spanner is engaged by what is termed a changeable head that can be rotated by way of a handwheel disposed at the bottom of the funnel. Such a device is expensive and unwieldly. Also, because of the complexity of the device, there is apparently a side exit 5 for the oil.

The Russian patent issue No. 1027-138-A is also a device used to remove drain plugs. The device uses a complicated shaft and handwheel assembly. As will be seen hereinafter, such a device does not serve the same purpose as the invention described herein.

SUMMARY OF THE INVENTION

The present invention provides a convenient, inexpensive, rugged and useful aid to either a professional or amateur mechanic in the removal of crankcase oil from a vehicular oil pan. The device is economically fabricated and can also be used in the refilling of the crankcase after it has been used to drain the crankcase.

A principal objective of this invention, therefore, is to provide a readily producible, easily operated, oil removal aid.

Another objective of this invention is to provide a cutting and drawing unit that is readily adaptable for use with the funnel of this invention.

Another objective of this invention is to provide an oil funnel which can be used with the socket of a conventional rachet wrench for purposes of final removal of oil plugs that protects the user from the rush of oil upon removal of the plug.

Another important objective of this invention is to provide a funnel that can be used for filling purposes as well as oil plug removal purposes.

While there are various arrangements that can be used within the scope of this invention, one example in accordance with the present invention is illustrated in the accompanying figures which are used for purposes of illustration.

DESCRIPTION OF THE PREFERRED EMBODIMENTS

Figure 1:
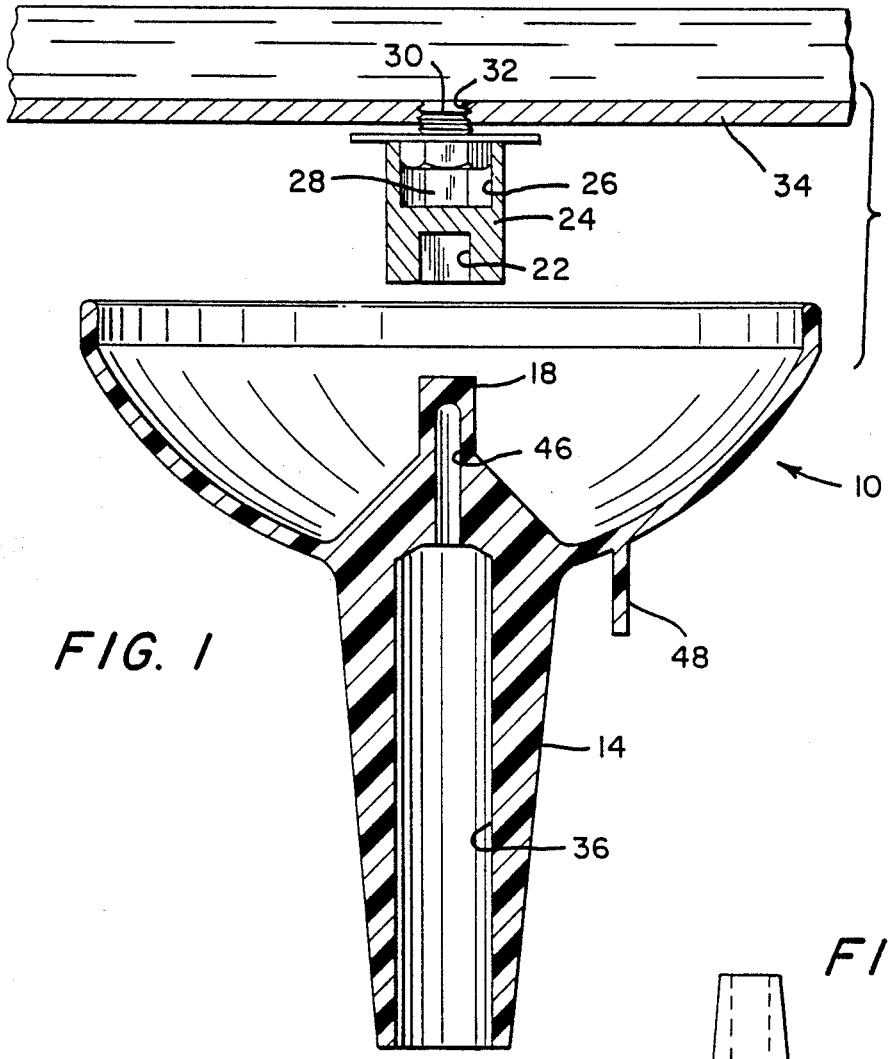
FIG. 1 is a vertical cross-section of the unit taken along the line 1—1 of FIG. 2.
Figure 4:
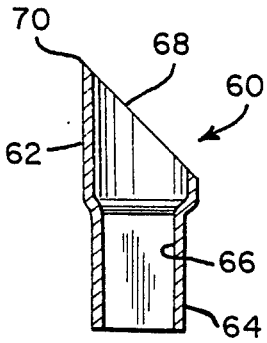
FIG. 4 is a cross-section of a cutting unit that is used with the funnel herein described.
Figure 6:
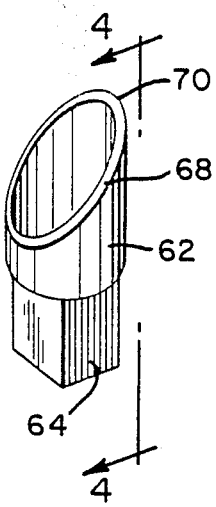
FIG. 6 is a perspective view of the unit shown in FIG. 4.

Referring now to the drawings wherein like numerals indicate like parts, the numeral 10 indicates a funnel. The funnel is composed of a bowl 12 from which a hollow stem 14 extends. The bowl is further defined by a top circular rim 16 and a centrally supported drive means 18. The drive means is square in shape and snugly engages the receptacle 22 of a conventional rachet wrench socket 24. At its other end the socket 24 has a receptacle 26 the size and shape of which is usually hexagonal. The hexagonal head 28 of a plug nut 30 is received in the drain aperture 32 of the automobile oil pan 34.

Figure 2:
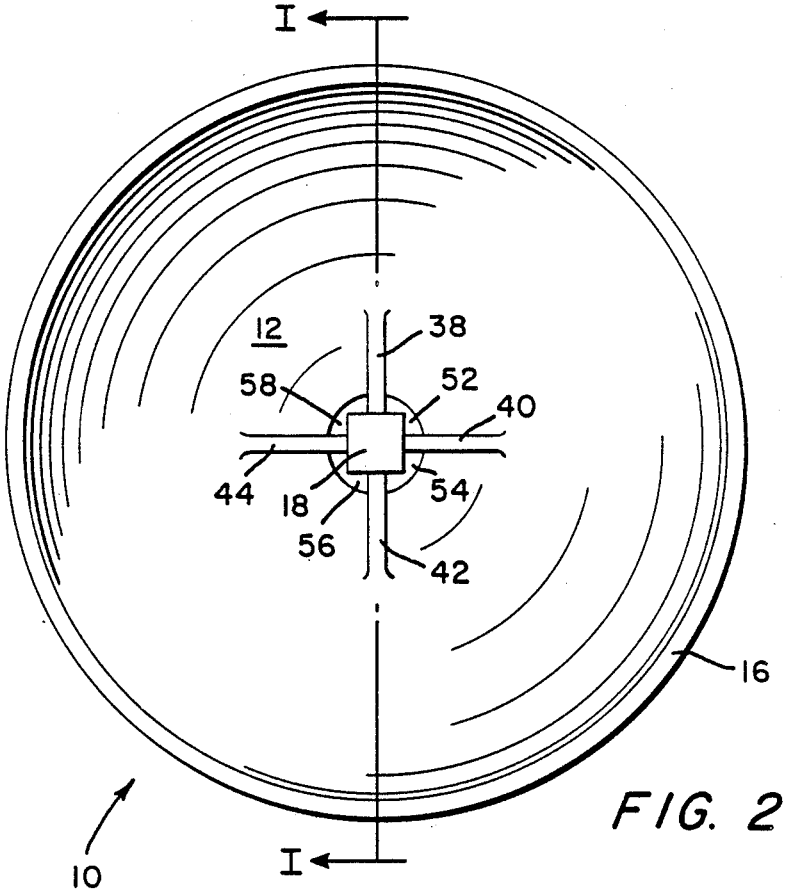
FIG. 2 is a top plan of the funnel shown in FIG. 1.
Figure 3:
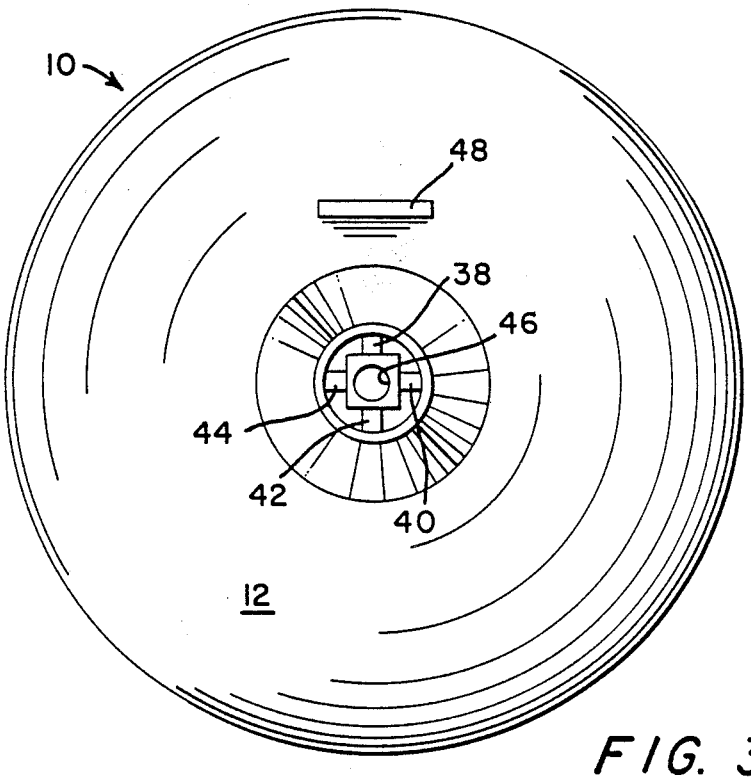
FIG. 3 is a bottom view of the funnel shown in FIG. 1.

As seen best in FIG. 2, the drive means 18 is supported above the hollow interior 36 of stem 14 by way of a plurality of struts 38, 40, 42 and 44. The drive means 18 is hollowed at 46 for lightness and to conserve materials. Funnel 10 is conveniently made of plastic. The bowl 12 has a lug 48 extending downwardly therefrom and is utilized for hanging the funnel at some convenient location.

In operation, the bolt 30 is partially loosened by way of a conventional ratchet wrench utilizing the socket 24 for use with a socket wrench. After several turns, the rachet itself is removed and the drive member 18 of the funnel is inserted into receptacle 22 and the bolt or nut 30 is removed by rotating the funnel 10. As the oil gushes from aperture 32 after plug removal, it will be gathered by the funnel and exhausted into a pan or the like (not shown) spaced therebelow. The oil moves through the spaces 52, 54, 56 and 58 that are defined by the strut members 38, 40, 42 and 44 and which openings communicate the interior of the bowl to the interior 36 of stem 14.

The invention herein lends itself to the use of an auxiliary device which is also useful in oil changing operations. After the oil has been drained from pan 34, the nut 30 is again placed in aperture 32 to seal the oil pan. If desired, the funnel 10 can be used for tightening purposes in the same manner that it was used to remove the nut 24.

A member 60, having a cylindrical portion 62 and a rectangular portion 64, is provided. The rectangular portion 64 has an interior 66 that snugly engages the outer surface of drive means 18.

Figure 5:
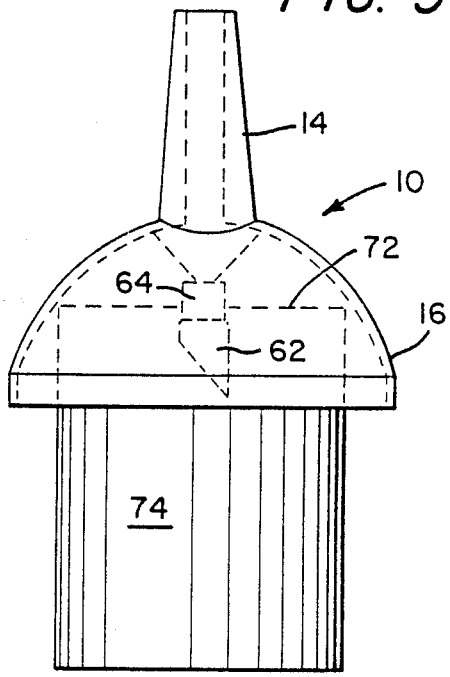
FIG. 5 is a diagrammatic showing of the cutting device and funnel used with an oil container of the type in which crankcase oil is commonly marketed.

The cylindrical portion 62 is terminated by a slanted cut 68 so as to provide a relatively sharp portion 70 at the end thereof. This member is inserted on the drive means 18 and is sufficiently strong and sharp to penetrate the upper end 72 of an oil can 74. The unit, i.e., the can and funnel, can be used to pour the oil from the can into the crankcase, as seen in FIG. 5.

It will be understood that the described device is but one example of an arrangement within the scope of the present invention and that various other arrangements also within the scope of the present invention will become obvious to those skilled in the art upon reading the disclosure set forth hereinbefore.

We claim:

1. A plastic funnel comprising;

a bowl having an open upper end defined by a rim and having a rounded bottom having an opening therethrough and defining an interior;

a nozzle stem having a bore throughout its length and said bore being in communication with the interior of said bowl;

a drive member having an upper end shaped to engage a socket for a socket wrench at its driven end;

a bridge network supporting said drive member within sid bowl without interrupting the communication between the interior of said bowl and bore; and a hollow cutting tool having a square end shaped to engage said member and a cylindrical member extending therefrom;

said cylindrical member having an outer end, a center axis and a distal end cut at an angle transverse to its center axis so as to provide a sharp cutting surface at its distal end.

2. The invention of claim 1, wherein said network is a plurality of struts extending between said drive member and the interior of said bowl and having substantial openings therebetween.

3. The invention of claim 1 wherein a lug is formed integral with said bowl and extends outwardly therefrom and generally parallel to said stem.

4. The invention of claim 1 wherein said bore is cylindrical and the outer surface of said stem tapers inwardly from said bowl to the distal end of said stem.

* * * * *